US009677383B2

(12) United States Patent
Sladic et al.

(10) Patent No.: US 9,677,383 B2
(45) Date of Patent: Jun. 13, 2017

(54) EROSION PORTS FOR SHUNT TUBES

(71) Applicant: Weatherford/Lamb, Inc., Houston, TX (US)

(72) Inventors: John S. Sladic, Katy, TX (US); Stephen McNamee, Rhode (IE); John Broussard, Kingwood, TX (US); Christopher A. Hall, Cypress, TX (US); Floyd R. Simonds, Jersey Village, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 166 days.

(21) Appl. No.: 14/190,818

(22) Filed: Feb. 26, 2014

(65) Prior Publication Data

US 2014/0238657 A1 Aug. 28, 2014

Related U.S. Application Data

(60) Provisional application No. 61/770,443, filed on Feb. 28, 2013.

(51) Int. Cl.
*E21B 43/04* (2006.01)
*E21B 41/00* (2006.01)

(52) U.S. Cl.
CPC ..... *E21B 41/0078* (2013.01); *E21B 43/04* (2013.01)

(58) Field of Classification Search
CPC .... E21B 41/0078; E21B 43/04; E21B 43/045; E21B 34/063
See application file for complete search history.

(56) References Cited

U.S. PATENT DOCUMENTS

| | | | |
|---|---|---|---|
| 2,800,912 | A | 7/1957 | McCamish et al. |
| 3,145,776 | A | 8/1964 | Pittman |
| 3,198,256 | A | 8/1965 | Kirby, II |
| 3,823,789 | A | 7/1974 | Garner |

(Continued)

FOREIGN PATENT DOCUMENTS

| | | | |
|---|---|---|---|
| CA | 2608050 | A1 | 4/2008 |
| CN | 101328793 | A | 12/2008 |

(Continued)

OTHER PUBLICATIONS

Pedroso, CA, et al., "Lighweight Proppants: Solution for Gravel Packing Horizontal Wells Under Extreme Conditions", SPE 98298; Feb. 2006; 1-12.

(Continued)

*Primary Examiner* — Kipp Wallace
(74) *Attorney, Agent, or Firm* — Blank Rome LLP

(57) ABSTRACT

A gravel pack apparatus for a wellbore has a shunt tube disposed along the apparatus near a wellscreen. The shunt tube is typically composed of stainless steel and has an internal passage for conducting slurry. Along its length, the tube has flow ports for passing the conducted slurry into the wellbore. The exit ports can use erosion inserts composed of erodible material, barrier inserts having breakable barriers, flow nozzles with external sheaths or caps, erosion-resistant bushings disposed on the flow nozzles, etc. The tube can also include a tube body having the exit ports and flow nozzles integrally formed thereon. The tube body can couple end-to-end with sections of shunt tube.

19 Claims, 10 Drawing Sheets

(56) References Cited

U.S. PATENT DOCUMENTS

| | | | | |
|---|---|---|---|---|
| 4,037,661 | A | 7/1977 | Ford | |
| 4,126,193 | A | 11/1978 | Brown et al. | |
| 4,189,243 | A | 2/1980 | Black | |
| 4,476,020 | A | 10/1984 | Cheetham | |
| 4,498,543 | A | 2/1985 | Pye et al. | |
| 4,522,264 | A | 6/1985 | McNeer | |
| 4,782,896 | A * | 11/1988 | Witten | 166/116 |
| 4,826,217 | A | 5/1989 | Guerrero | |
| 4,932,474 | A * | 6/1990 | Schroeder, Jr. | E21B 43/045 166/278 |
| 5,082,052 | A | 1/1992 | Jones et al. | |
| 5,577,559 | A | 11/1996 | Voll et al. | |
| 5,597,040 | A | 1/1997 | Stout et al. | |
| 5,636,691 | A | 6/1997 | Hendrickson et al. | |
| 5,661,767 | A | 8/1997 | Roux | |
| 5,676,208 | A | 10/1997 | Finley | |
| 5,823,273 | A | 10/1998 | Ravi et al. | |
| 5,829,539 | A | 11/1998 | Newton et al. | |
| 5,842,516 | A | 12/1998 | Jones | |
| 5,918,911 | A | 7/1999 | Sims | |
| 6,138,777 | A | 10/2000 | Fraim et al. | |
| 6,227,303 | B1 | 5/2001 | Jones | |
| 6,491,097 | B1 | 12/2002 | Oneal et al. | |
| 6,557,634 | B2 | 5/2003 | Hailey, Jr. et al. | |
| 6,588,507 | B2 * | 7/2003 | Dusterhoft et al. | 166/278 |
| 6,749,023 | B2 | 6/2004 | Nguyen et al. | |
| 6,973,974 | B2 | 12/2005 | McLoughlin et al. | |
| 7,096,946 | B2 | 8/2006 | Jasser et al. | |
| 7,373,989 | B2 | 5/2008 | Setterberg, Jr. | |
| 7,419,002 | B2 | 9/2008 | Dybevik et al. | |
| 7,497,267 | B2 | 3/2009 | Setterberg, Jr. et al. | |
| 7,503,384 | B2 | 3/2009 | Coronado | |
| 7,559,357 | B2 | 7/2009 | Clem | |
| 7,597,141 | B2 | 10/2009 | Rouse et al. | |
| 7,753,128 | B2 * | 7/2010 | Moen | 166/370 |
| 7,841,396 | B2 | 11/2010 | Surjaatmadja | |
| 7,886,819 | B2 | 2/2011 | Setterberg, Jr. et al. | |
| 8,376,038 | B2 | 2/2013 | Hammer | |
| 2002/0108752 | A1 | 8/2002 | Morey et al. | |
| 2002/0125006 | A1 | 9/2002 | Hailey, Jr. et al. | |
| 2003/0075325 | A1 | 4/2003 | Dusterhoft et al. | |
| 2004/0140089 | A1 | 7/2004 | Gunneroed | |
| 2005/0028977 | A1 | 2/2005 | Ward | |
| 2005/0061501 | A1 | 3/2005 | Ward et al. | |
| 2005/0082060 | A1 | 4/2005 | Ward et al. | |
| 2005/0236153 | A1 | 10/2005 | Fouras et al. | |
| 2005/0284643 | A1 | 12/2005 | Setterberg, Jr. | |
| 2006/0022073 | A1 | 2/2006 | King et al. | |
| 2006/0151174 | A1 | 7/2006 | Cantin et al. | |
| 2006/0191685 | A1 * | 8/2006 | Coronado | 166/278 |
| 2006/0237197 | A1 | 10/2006 | Dale et al. | |
| 2008/0314588 | A1 * | 12/2008 | Langlais et al. | 166/278 |
| 2009/0255667 | A1 | 10/2009 | Clem et al. | |
| 2011/0132603 | A1 | 6/2011 | Martinez et al. | |
| 2011/0192613 | A1 * | 8/2011 | Garcia et al. | 166/373 |
| 2012/0031611 | A1 | 2/2012 | Xu | |
| 2013/0112399 | A1 | 5/2013 | Royer et al. | |
| 2013/0140093 | A1 * | 6/2013 | Zhou | E21B 10/58 175/336 |

FOREIGN PATENT DOCUMENTS

| | | | |
|---|---|---|---|
| EP | 0935050 | A2 | 8/1999 |
| EP | 1609946 | A2 | 12/2005 |
| EP | 2423431 | A2 | 2/2012 |
| GB | 640310 | | 7/1950 |
| GB | 2178342 | A | 2/1987 |
| GB | 2220688 | A | 1/1990 |
| GB | 2220688 | B | 1/1992 |
| GB | 2370054 | A | 6/2002 |
| GB | 2426989 | A | 12/2006 |
| WO | 2004/018837 | A1 | 3/2004 |

OTHER PUBLICATIONS

Porter, DA, et al., "Designing and Completing High-Rate Oil Producers in a Deepwater Unconsolidated Sand", SPE 58735; Feb. 2000; 1-19.

Ross, Colby M., "New Tool Designs for High Rate Gravel Pack Operations", SPE 29276; Mar. 1995; 227-234.

Hill, Leo E, "Completion Tools Proven Successful in Deepwater Frac Packs and Horizontal Gravel Packing", IADC/SPE 74492; Feb. 2002,1-15.

Mendez, A, et al., "A Quantum Leap in Horizontal Gravel Pack Technology", SPE 94945; Jun. 2005; 1-7.

Burton, R.C., et al., Innovative Completion Design and Well Performance Evaluation for Effective Frac-Packing of Long Intervals: A Case Study from the West Natuna Sea, Indonesia, SPE 74351; Feb. 2002; 1-24.

Search Report received in corresponding EP Appl. 14157193.5, mailed Jul. 22, 2014.

Welltonic, "Abrasive Jetting Sub," Brochure, available from http://www.welltonic.co.uk, obtained on undated.

Weatherford, "Conventional Well Screens," Brochure, copyright 2004-2010.

State Intellectual Property Office of People's Republic of China; "The First Office Action"; received in corresponding CN Appl. 201410073926.3; mailed Jan. 25, 2016; pp. 1-16.

Examination Report No. 1 in counterpart Australian Appl. 2014201020, dated May 5, 2016.

Examination Report No. 1 in counterpart Australian Appl. 2014201020, dated Apr. 12, 2016.

Written Opinion in counterpart Singapore Appl. 10201400249B, dated Mar. 7, 2017.

* cited by examiner

EROSION PORTS FOR SHUNT TUBES

CROSS-REFERENCE TO RELATED APPLICATIONS

This application claims the benefit of U.S. Appl. No. 61/770,443, filed 28 Feb. 2013, which is incorporated herein by reference in its entirety.

BACKGROUND OF THE DISCLOSURE

A wellscreen may be used on a production string in a hydrocarbon well and especially in a horizontal section of the wellbore. Typically, the wellscreen has a perforated basepipe surrounded by a screen that blocks the flow of particulates into the production string. Even though the screen may filter out particulates, some contaminants and other unwanted materials can still enter the production string.

To reduce the inflow of unwanted contaminants, operators can perform gravel packing around the wellscreen. In this procedure, gravel (e.g., sand) is placed in the annulus between wellscreen and the wellbore by pumping a slurry of liquid and gravel down a workstring and redirecting the slurry to the annulus with a crossover tool. As the gravel fills the annulus, it becomes tightly packed and acts as an additional filtering layer around the wellscreen to prevent the wellbore from collapsing and to prevent contaminants from entering the production string.

Ideally, the gravel uniformly packs around the entire length of the wellscreen, completely filling the annulus. However, during gravel packing, the slurry may become more viscous as fluid is lost into the surrounding formation and/or into the wellscreen. Sand bridges can then form where the fluid loss occurs, and the sand bridges can interrupt the flow of the slurry and prevent the annulus from completely filling with gravel.

As shown in FIG. 1, for example, a wellscreen 30 is positioned in a wellbore 14 adjacent a hydrocarbon bearing formation. Gravel 13 pumped in a slurry down the production tubing 11 passes through a crossover tool 33 and fills an annulus 16 around the wellscreen 30. As the slurry flows, the formation may have an area of highly permeable material 15, which draws liquid from the slurry. In addition, fluid can pass through the wellscreen 30 into the interior of the tubular and then back up to the surface. As the slurry loses fluid at the permeable area 15 and/or the wellscreen 30, the remaining gravel may form a sand bridge 20 that can prevent further filling of the annulus 16 with gravel.

To overcome sand-bridging problems, shunt tubes have been developed to create an alternative route for gravel around areas where sand bridges may form. For example, a gravel pack apparatus 100 shown in FIGS. 2A-2B positions within a wellbore 14 and has shunt tubes 145 for creating the alternate route for slurry during the gravel pack operation. As before, the apparatus 100 can connect at its upper end to a crossover tool (33; FIG. 1), which is in turn suspended from the surface on tubing or workstring (not shown).

The apparatus 100 includes a wellscreen assembly 105 having a basepipe 110 with perforations 120 as described previously. Disposed around the base pipe 110 is a screen 125 that allows fluid to flow therethrough while blocking particulates. The screen 125 can be a wire-wrapped screen, although the wellscreen assembly 105 can use any structure commonly used by the industry in gravel pack operations (e.g. mesh screens, packed screens, slotted or perforated liners or pipes, screened pipes, pre-packed screens and/or liners, or combinations thereof).

The shunt tubes 145 are disposed on the outside of the basepipe 110 and can be secured by rings (not shown). As shown in FIG. 2A, centralizers 130 can be disposed on the outside of the basepipe 110, and a tubular shroud 135 having perforations 140 can protect the shunt tubes 145 and wellscreen 105 from damage during insertion of the apparatus 100 into the wellbore 14.

At an upper end (not shown) of the apparatus 100, each shunt tube 145 can be open to the annulus 16. Internally, each shunt tube 145 has a flow bore for passage of slurry. Nozzles 150 disposed at the ports 147 in the sidewall of each shunt tube 145 allow the slurry to exit the shunt tube 145. As shown in FIG. 2C, the nozzles 150 can be placed along the shunt tube 145 so each nozzle 150 can communicate slurry from the ports 147 and into the surrounding annulus 16. As shown, the nozzles 150 are typically oriented to face toward the wellbore's downhole end (i.e., distal from the surface) to facilitate streamlined flow of the slurry therethrough.

In a gravel pack operation, the apparatus 100 is lowered into the wellbore 14 on a workstring and is positioned adjacent a formation. A packer (18; FIG. 1) is set, and gravel slurry is then pumped down the workstring and out the outlet ports in the crossover tool (33; FIG. 1) to fill the annulus 16 between the wellscreen 105 and the wellbore 14. Since the shunt tubes 145 are open at their upper ends, the slurry can flow into both the shunt tubes 145 and the annulus 16, but the slurry typically stays in the annulus as the path of least resistance at least until a bridge is formed. As the slurry loses liquid to a high permeability portion 15 of the formation and the wellscreen 30, the gravel carried by the slurry is deposited and collects in the annulus 16 to form the gravel pack.

Should a sand bridge 20 form and prevent further filling below the bridge 20, the gravel slurry continues flowing through the shunt tubes 145, bypassing the sand bridge 20 and exiting the various nozzles 150 to finish filling annulus 16. The flow of slurry through one of the shunt tubes 145 is represented by arrow 102.

Due to pressure levels and existence of abrasive matter, the flow of slurry in the shunt tubes 145 tends to erode the nozzles 150, reducing their effectiveness and potentially damaging the tool. To reduce erosion, the nozzles 150 typically have flow inserts that use tungsten carbide or a similar erosion-resistant material. The resistant insert fits inside a metallic housing, and the housing welds to the exterior of the shunt tube 145, trapping the carbide insert.

For example, FIG. 3A shows a cross-sectional view of a prior art nozzle 150 disposed on a shunt tube 145 at an exit port 147. For further reference, FIGS. 3B-3C show perspective and cross-sectional views of the prior art nozzle 150. For slurry to exit the shunt tube 145, the exit port 147 is drilled in the side of the tube 145 typically with an angled aspect in approximate alignment with a slurry flow path 102 to facilitate streamlined flow. Like the port 147, the nozzle 150 also has an angled aspect, pointing downhole and outward away from the shunt tube 145.

A tubular carbide insert 160 of the nozzle 150 is held in alignment with the drilled port 147, and an outer jacket 165 of the nozzle 150 is attached to the shunt tube 145 with a weld 170, trapping the carbide insert 160 against the shunt tube 145 and in alignment with the drilled hole 147. The outer jacket 165 is typically composed of a suitable metal, similar to that used for the shunt tube 145. The outer jacket 165 serves to protect the carbide insert 160 from high weld temperatures, which could damage or crack the insert 160. With the insert 160 held by the outer jacket 165 in this manner, sand slurry exiting the tube 145 through the nozzle 150 is routed through the carbide insert 160, which is resistant to damage from the highly abrasive slurry.

The nozzle 150 and the manner of constructing it on the shunt tube 145 suffer from some drawbacks. During welding of the nozzle 150 to the shunt tube 145, the nozzle 150 can shift out of alignment with the drilled hole 147 in the tube 145 so that exact alignment between the nozzle 150 and the drilled hole 147 after welding is not assured. To deal with this, a piece of rod (not shown) may need to be inserted through the nozzle 150 and into the drilled hole 147 to maintain alignment during the welding. However, holding the nozzle 150 in correct alignment while welding it to the shunt tube 145 is cumbersome and requires time and a certain level of skill and experience.

In another drawback, the carbide insert 160 actually sits on the surface of the shunt tube 145, and the hole 147 in the tube's wall is part of the exit flow path 102. Consequently, abrasive slurry passing through the hole 147 may cut through the relatively soft material of the shunt tube 145 and may bypass the carbide insert 160 entirely, causing the shunt tube 145 to fail prematurely.

To address some of the drawbacks, other nozzle configurations have been disclosed in U.S. Pat. Nos. 7,373,989 and 7,597,141, which are incorporated herein by reference. U.S. Pat. Pub. No. 2008/0314588 also discloses other nozzles for shunt tubes.

Although existing nozzles may be useful and effective, the arrangements still complicate manufacture of downhole tools, alter the effective area available in the tool for design and operation, and have features prone to potential failure. Accordingly, the subject matter of the present disclosure is directed to overcoming, or at least reducing the effects of, one or more of the problems set forth above.

SUMMARY OF THE DISCLOSURE

A gravel pack apparatus for a wellbore has a flow tube with a flow passage for conducting slurry during a gravel pack or other operation. The flow passage has at least one flow port for passing the conducted slurry into the wellbore. Typically, the apparatus has a basepipe having a through-bore and defining a perforation communicating into the through-bore. A screen is disposed on the basepipe adjacent the perforation for screening fluid flow into the basepipe. The flow tube is disposed adjacent the screen for conducting the slurry past any bridges or the like that may form in the wellbore annulus during the operation.

At least one insert is disposed at the at least one flow port in the flow tube. In one arrangement, the at least one insert defines at least one aperture therethrough allowing passage of the conducted slurry from the flow tube to the wellbore. The at least one insert is composed of an erodible material and erodes via the conducted slurry through the at least one aperture and allows passage of the slurry from an initial flow rate to a subsequently greater flow rate. In addition to the at least one aperture, the insert can have at least one slot defined at least partially in at least one side of the at least one insert to facilitate erosion.

In one arrangement, the at least one insert can have a thread disposed thereabout and can thread into the at least one flow port of the flow tube, although other forms of affixing can be used. Typically, multiple flow ports and nozzles are used on the flow tube. In this instance, the various inserts can be configured to erode in a predetermined pattern along the length of the flow tube. In other words, the inserts disposed toward one end (e.g., proximal end) of the flow tube may be configured to erode in the predetermined pattern before the inserts disposed toward another end (e.g., distal end) of the flow tube. One way to configure this is to use a same or different number of the at least one apertures in the various inserts, although other techniques can be used.

In another arrangement, the at least one insert disposed at the at least one flow port on the disclosed gravel pack apparatus can defining a flow passage therethrough and can have a barrier disposed across the flow passage. The barrier is breachable or breakable and allows passage of the conducted slurry through the flow passage once broken.

Therefore, when multiple inserts with barriers are used on the flow tube, the barriers can be configured to be breached in a predetermined pattern along the length of the flow tube. In this way, the inserts disposed toward one end of the flow tube can be configured to be breached in the predetermined pattern before the inserts disposed toward another end of the flow tube.

In one arrangement of the flow tube, the flow tube of the disclosed apparatus can have first and second flow tube sections—each having an internal passage conducting slurry. The insert affixes end-to-end to the first and second flow tube sections and has a flow passage communicating with the internal passages of the first and second flow tube sections.

The insert can have a plurality of exit ports communicating the conducted slurry to the wellbore. These exit ports can have flow nozzles disposed on the insert. The flow nozzles can be disposed on a same side or different sides of the insert, and the flow nozzles can be disposed in the same direction or different directions on the insert.

In yet another arrangement of the disclosed gravel pack apparatus, the nozzle disposed on the flow tube at the flow port is composed of a first material. The nozzle has inner and outer sidewalls, and the inner sidewall defines a flow passage communicating the conducted slurry therethrough. An erosion-resistant material different from the first material is disposed at least externally on the external surface of the nozzle.

The erosion-resistant material can be a sheath disposed at least externally on the external surface of the nozzle, or the erosion-resistant material comprises a buildup of the erosion resistant material that is disposed on the flow tube and disposed externally about the nozzle. Alternatively, the erosion-resistant material can be a bushing disposed in between the inner and outer sidewalls of the nozzle. A distal end connected between the inner and outer sidewalls of the nozzle can encapsulate the bushing in between the inner and outer sidewalls, or a retainer affixed to the distal end can be used.

The foregoing summary is not intended to summarize each potential embodiment or every aspect of the present disclosure.

DETAILED DESCRIPTION OF THE DISCLOSURE

A. Erosion Inserts

Figure 4A:
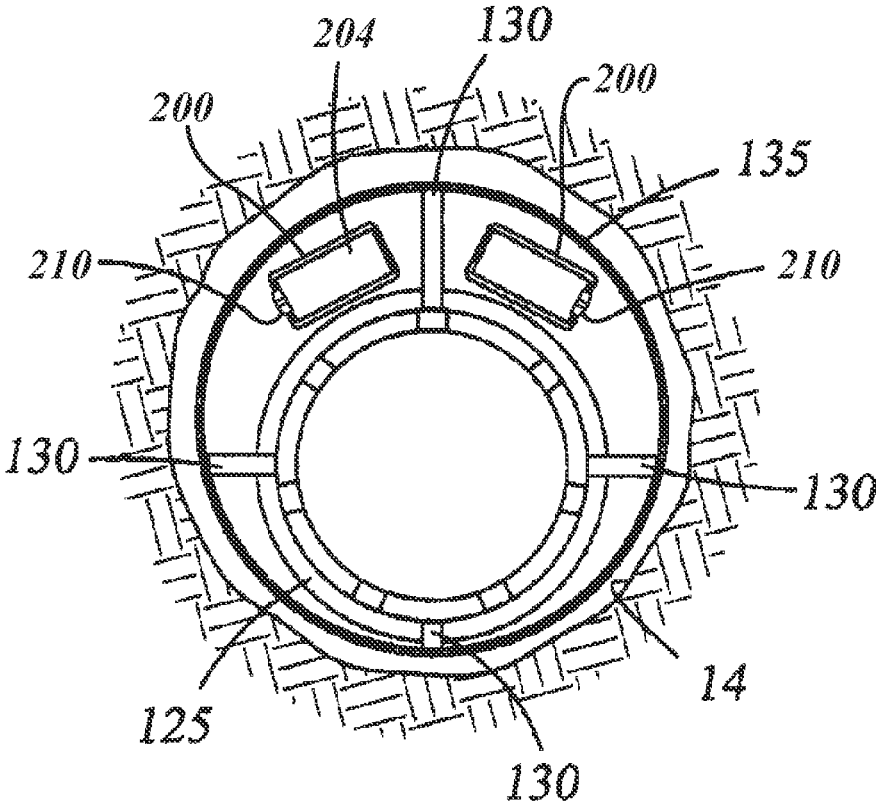
FIG. 4A is an end view of a gravel pack apparatus according to the present disclosure positioned within a wellbore.

FIG. 4A shows an end view of a gravel pack apparatus 100 according to the present disclosure. As noted previously, the apparatus 100 can have a number of shunt tubes 200 to create an alternative route for gravel around areas where sand bridges may form in a wellbore 14 and has shunt tubes 200 for creating the alternate route for slurry during the gravel pack operation. Again, the apparatus 100 includes a wellscreen assembly 105 having a basepipe 110 with perforations 120 as described previously. Disposed around the basepipe 110 is a screen 125 that allows fluid to flow therethrough while blocking particulates. The screen 125 can be a wire-wrapped screen, although the wellscreen assembly 105 can use any structure commonly used by the industry in gravel pack operations (e.g. mesh screens, packed screens, slotted or perforated liners or pipes, screened pipes, pre-packed screens and/or liners, or combinations thereof).

The shunt tubes 200 are disposed on the outside of the basepipe 110 and can be secured by rings (not shown). As shown, centralizers 130 can be disposed on the outside of the basepipe 110, and a tubular shroud 135 having perforations 140 can protect the shunt tubes 200 and the wellscreen 105 from damage during insertion of the apparatus 100 into the wellbore 14. In other arrangements, the centralizers 130 and shroud 135 may not be used. Although not shown, it will be appreciated that transport tubes (not shown) lacking nozzles or exit ports can be used on the assembly 105 to transport slurry from joint to joint and can connect to the transport shunt tubes having the exit ports or nozzles.

At an upper end (not shown) of the apparatus 100, each shunt tube 200 can be open to the annulus to receive flow of slurry during a gravel pack operation when bridging or other problems occur. Alternatively, the upper end of a shunt tube 200 may connect to a transport tube running along the assembly 105. Internally, each shunt tube 200 has a flow bore 204 for passage of the slurry, and exit ports 206 in the sidewall 202 of each shunt tube 200 allow the slurry to exit the tube 200 to the surrounding wellbore.

Rather than having conventional nozzles on the exit ports 206, the shunt tubes 200 have a plurality of erosion inserts 210 disposed in the exit ports 206. As shown in the side view of a shunt tube 200 in FIG. 4B, the erosion inserts 210 can be placed along the shunt tube 200 so each erosion insert 210 can control communication of slurry from the tube's exit ports 206 and into the surrounding annulus. As may be typical, the tube's exit ports 206 can be oriented along one side of the shunt tube 200, although any other configuration can be used. In any event, a plurality of exit ports 206 and erosion inserts 210 are disposed along the length of the shunt tube 200 to distribute slurry during gravel packing.

Each erosion insert 210 has one or more internal apertures, holes, or openings 212 defined therein. Thinned areas 214 from slots may also be provided to facilitate erosion and/or to facilitate insertion of the insert 210 in the exit ports 206. As shown in the cross-section of FIG. 4C, the inserts 210 can thread into the exit ports 206, but the inserts 210 can affix in any number of ways in the exit ports 206, including, for example, by welding, soldering, press fitting, or the like in the ports 206. Moreover, not all of the exit ports 206 need to have inserts 210 that will allow for flow therethrough. Instead, blanks or blocking plugs (not shown) can be disposed in any of the exit ports 206 to prevent flow at the particular port 206. This may allow operators to adjust or modify the configuration of flow through various exit ports 206 as plans change in the field or the like.

The shunt tube 200 is composed of a suitable metal, such as 316L grade stainless steel. By contrast, the inserts 210 can be composed of an eroding material, such as a soft metal, including brass, aluminum, or the like. The number, size, and placement of the initial openings 212 and other features of the erosion insert 210 can be configured for a particular implementation with consideration for slurry grain size, slurry flow rate, pressure levels, desired erosion rate of the insert 210, type of material used for the insert 260, etc. The openings 212 and/or the exit ports 206 can be sized relative to a mean diameter of the gravel by a given factor to reduce the chances of a blockage from forming.

During gravel pack operations, slurry may eventually enter an open end (not shown) of the shunt tube 200 and may travel along the tube's flow passage 204. For example, the shunt tube 200 may be open at its uphole end, and the slurry may flow into the shunt tube 200 and the annulus. As the slurry loses carrier fluid to a high permeability portion of the surrounding formation, the gravel carried by the slurry is deposited and collects in the annulus to form the gravel pack. If the liquid is lost to a permeable stratum in the formation before the annulus is filled, however, a sand bridge may form that blocks flow through the annulus and prevent further filling below the bridge. If this occurs, the gravel slurry continues flowing through the shunt tube 200, bypassing the sand bridge, and exiting the various exit ports 206 with erosion inserts 210 to finish filling the annulus. As the slurry is diverted to the shunt tubes 200, and the gravel pack progresses from heel to toe, the slurry may only travel the distance between exit ports 206, which may be 3 ft. or so separate from one another, in the open hole.

Figure 4E:
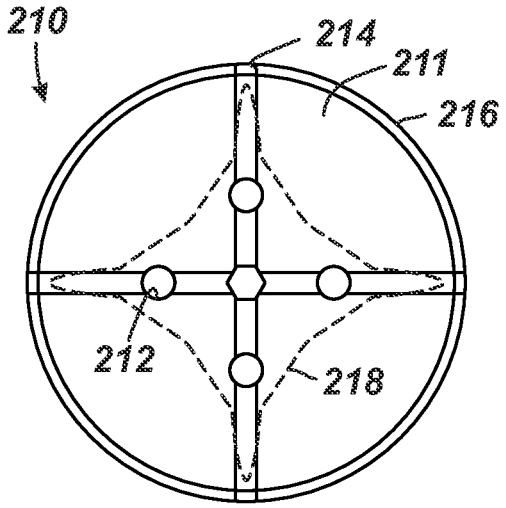
FIG. 4E is a plan view of one type of erosion insert.
Figure 4B:
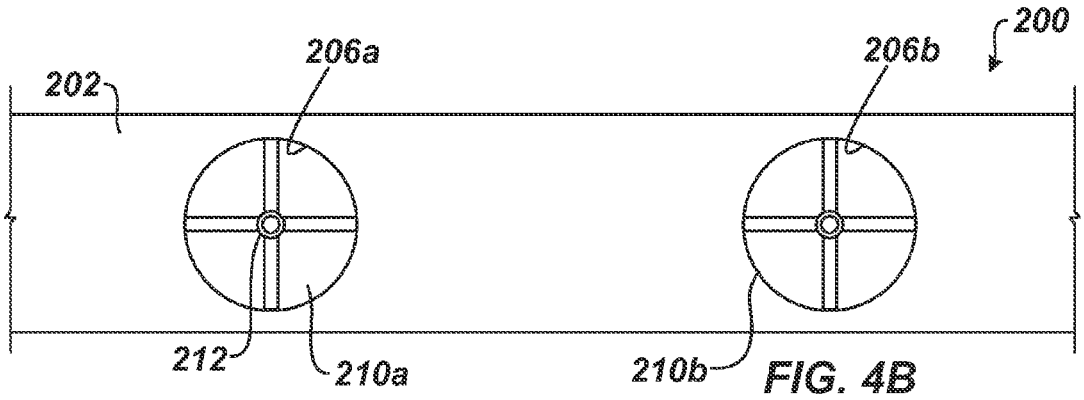
FIG. 4B is a top view of a shunt tube having erosion inserts disposed in exit ports.
Figure 4C:
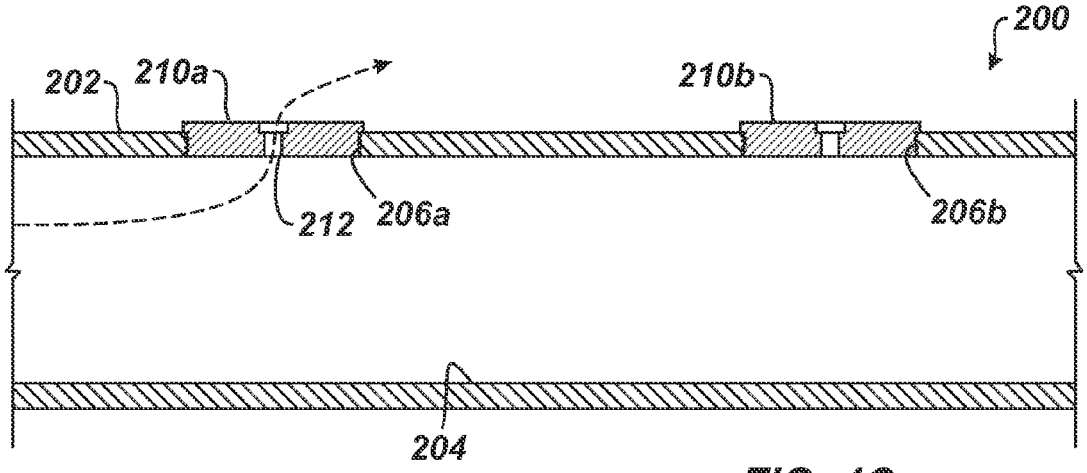
FIG. 4C-D are side cross-sectional views of the shunt tube having the erosion inserts of FIG. 4B.
Figure 4D:
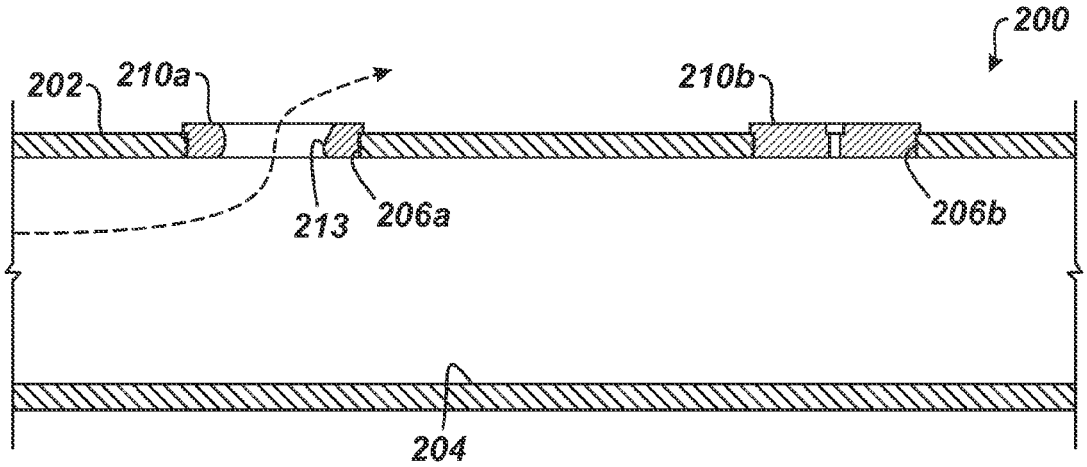

Looking at FIGS. 4C-4D in more detail, the slurry traveling along the shunt tube 200 reaches the first of the exit ports 206*a* having a first of the erosion inserts 210*a*. Taking the path of least resistance, the flow of slurry begins to flow through the initial openings 212 of this insert 210*a* and into the borehole annulus. The flow from the shunt tube 200 out the exit port 206 is thereby restricted initially to an initial flow rate. In this case, the restricted flow would not tend to erode any surrounding casing, if present, and would not erode the side of the open borehole outside the shunt tube 200. Also, the exiting slurry would not tend to impinge any surrounding surface and bounce back to erode adjacent portions of the shunt tube 200. Finally, the restricted flow would not tend to exit at a high velocity that could erode surrounding components of the gravel pack assembly, such as a protective shroud or the like.

Eventually, the slurry exiting the first insert 210*a* erodes the openings 212 so that the flow is less restricted. As more flow passes in a subsequently greater flow rate, the first insert 210*a* erodes away as shown in FIG. 4D so that the insert 210*a* may define a much larger opening 213 or may actually come out of the exit port 206. In any event, sand out may eventually occur at the first exit port 206*a* as gravel from the exiting slurry packs around the shunt tube 200 and restricts flow of slurry out the first exit port 206*a*.

When sandout begins to occur, the slurry begins to flow primarily out the next exit port 206*b* and its erosion insert 210*b* further down the shunt tube 200. This insert 210*b* begins to erode with the flow of slurry eventually until sandout is reached. This process then repeats itself sequentially along the length of the shunt tube 200. Of course, depending on the flow of the slurry, the path of least resistance for its flow, and other given variables, the progression of the slurry exiting the exit ports 206 may be uphole, downhole, or a combination of both along the shunt tube 200.

Accordingly, the inserts 210 can be configured to erode in a predetermined pattern along the length of the shunt tube 200. Thus, the inserts 210 disposed toward one end (e.g., uphole end) of the shunt tube 200 can be configured to erode in the predetermined pattern before the inserts 210 disposed toward another end (e.g., downhole end) of the shunt tube 200. The reverse arrangement or some mixed arrangement can also be used. To achieve the desired configuration, each of the inserts 210 can have a same or different number of the at least one aperture therein and can be configured with thicknesses, diameters, and/or materials to control their erosion characteristics.

As noted above, the erosion insert 210 can have any number of openings or other features to control erosion and flow during gravel pack operations. FIG. 4E shows one variation. The insert 210 has an inner surface 211 and a perimeter 216. The inner surface 211 may be intended to face inward toward the flow passage (204) of the shunt tube (200), although the reverse arrangement could be used. The perimeter 216 can have thread or the like for holding the insert 210 in the tube's port (206).

A series of small apertures, orifices or holes 212 are defined through the insert 210 and allow a limited amount of flow to pass from the shunt tube (200). In this particular example, the orifices 212 are arranged in a peripheral cross-pattern around the center, and joined slots 214 in the inner surface 211 can pass through the peripheral orifices 212. Initial flow through the orifices 212 may be small enough to restrict the flow of slurry as disclosed herein. As the slurry continues to pass through the small orifices 212, however, rapid erosion is encouraged by the pattern of the orifices 212 and the slots 153. In general, the central portion 218 of the insert 210 erodes due to the several orifices 212. Erosion can also creep along the slots 214 where the insert 210 is thinner, essentially dividing the insert 210 into quarters. These and other patterns and arrangement of holes and features can be used on the erosion inserts 210 of the present disclosure.

B. Barrier Insert

Figure 5A:
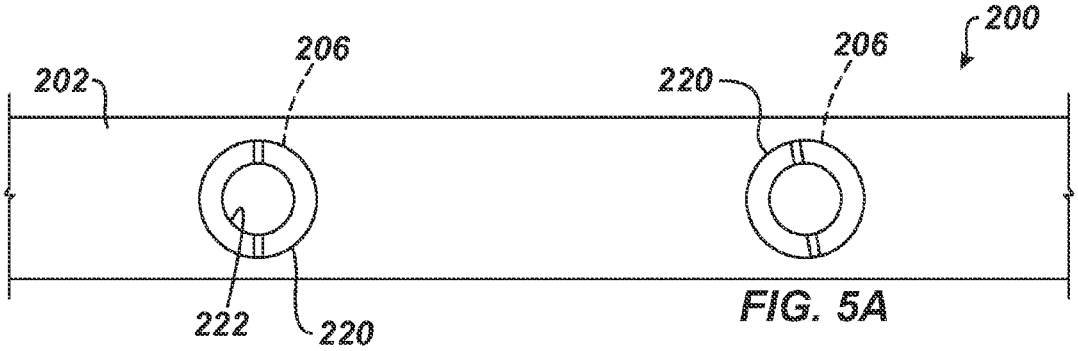
FIG. 5A is a top view of a shunt tube having burst inserts disposed in exit ports.
Figure 5B:
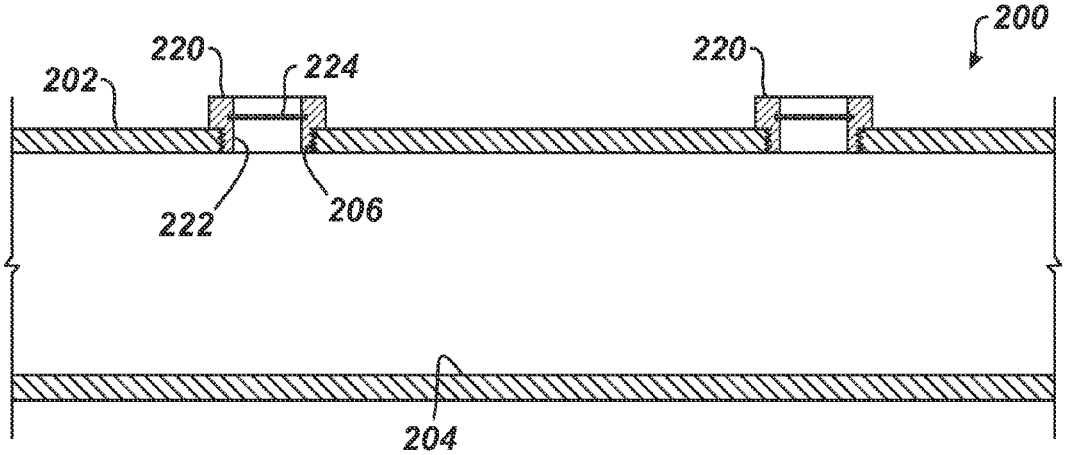
FIG. 5B-5C are side cross-sectional views of the shunt tube having the burst inserts of FIG. 5B.
Figure 5C:
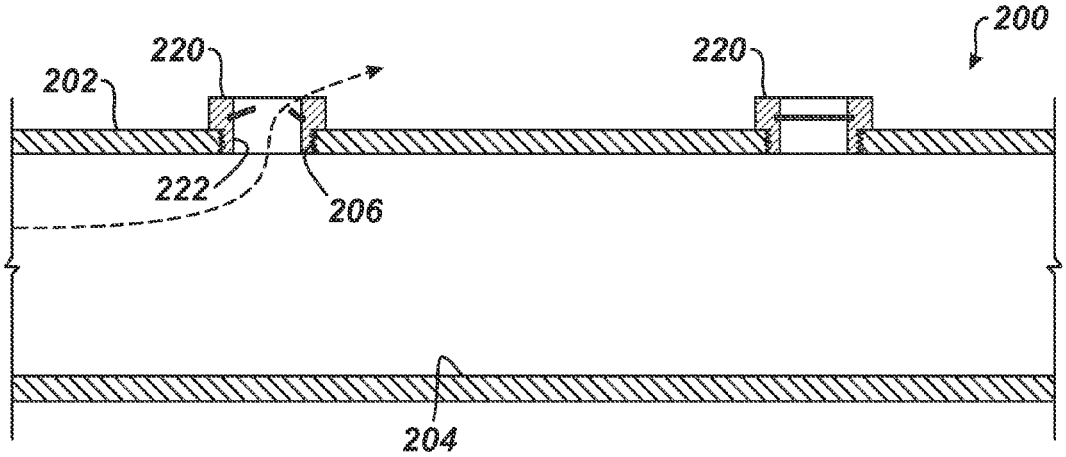

Turning now to FIGS. 5A-5C, another embodiment of a shunt tube 200 has a plurality of burst inserts 220 disposed in the exit ports 206 of the shunt tube 200. The burst inserts 220 can thread into the exit ports 206 as shown in the tube's sidewall 202, although any other method of affixing the inserts 220 can be used. The burst inserts 220 have an internal passage 222 with a temporary barrier 224 disposed therein. The barrier 224 can be composed of any suitable material, such as metal, ceramic, and the like. Additionally, the barrier 224 may be similar to a rupture disc and may or may not have apertures therein.

Being breachable, the barrier 224 breaks or bursts when subject to a pressure differential as slurry in the flow passage 204 of the shunt tube 200 acts against one side of the barrier 224. Once the barrier 224 is broken, the slurry in the tube's flow passage 204 can pass to the surrounding annulus. The various barriers 224 for the inserts 220 can be configured to burst at a predetermined pressure differential suited for the implementation. All of the barriers 224 may be configured the same along the shunt tube 200, or the barriers 224 may be configured to burst at increasing or decreasing pressures from one another along the length of the tube 200. These and other arrangements can be used.

As shown in FIG. 5C, the insert 220 can define a flow nozzle once the barrier 224 bursts, and flow of the slurry can exit out of the tube's passage 204 through the insert's passage 222 to the annulus. The orientation of the insert 220 is shown perpendicular to the axis of the shunt tube 200, although any other orientation can be used.

Figure 6A:
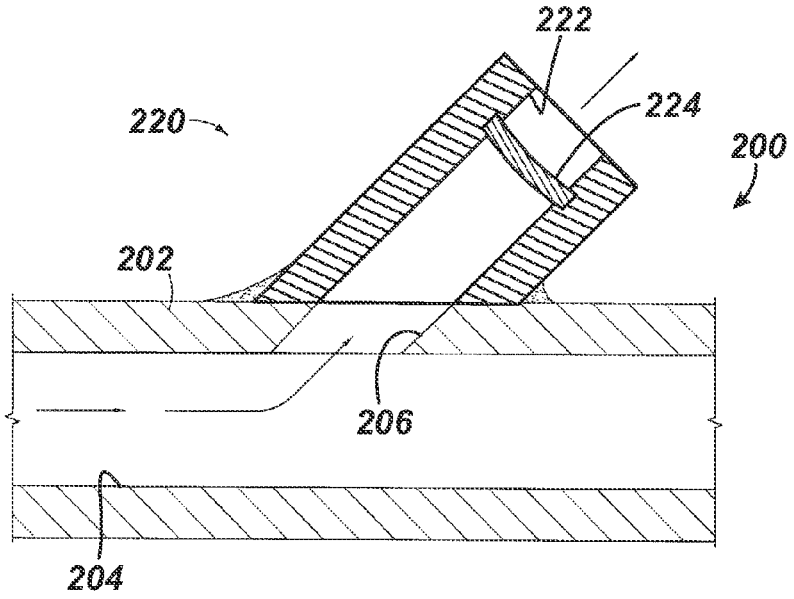
FIG. 6A is a side cross-sectional view of a flow nozzle having a burst disc therein.

For example, FIG. 6A shown a burst insert 220 in the form of a cylindrical nozzle affixed to the shunt tube 200 at the exit port 206. As shown here, weldment can be used to affix the burst insert 220 to the tube 200, and the burst insert 220 can be angled to direct the flow of slurry exiting the port 206. A typical angle is about 45-degrees toward the downhole end of the tube 200, although other orientations can be used.

The nozzle-style burst insert 220 has a burst disc or barrier 224 disposed therein. As before, the barrier 224 is configured to burst from the buildup of slurry pressure at a predetermined point. This can be configured for a particular pressure buildup and can be designed for a particular implementation.

C. Tube Body Insert

Figure 6B:
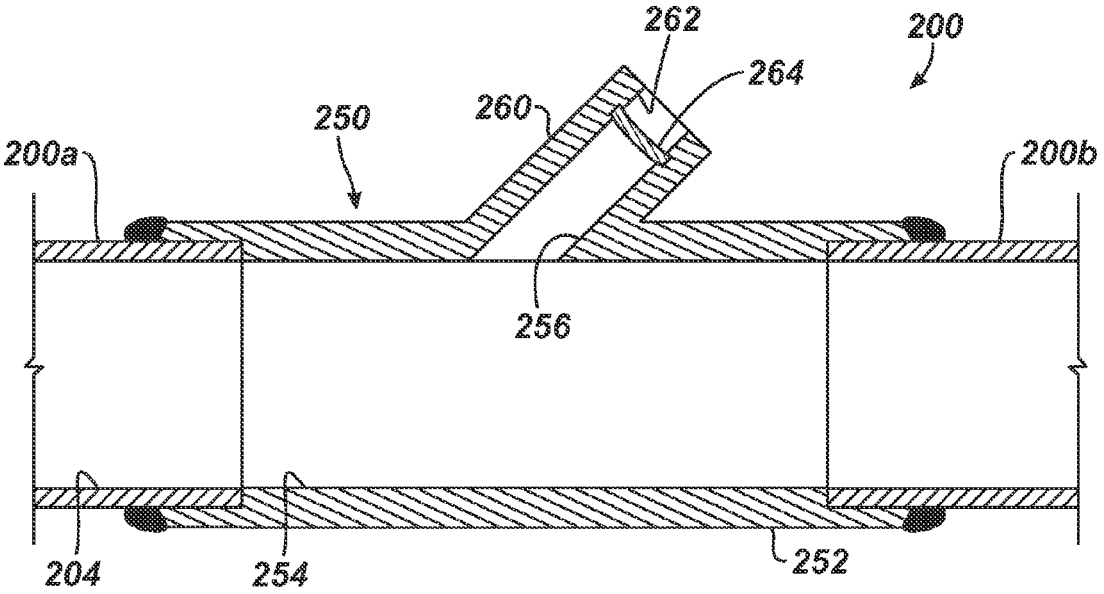
FIG. 6B is a side cross-sectional view of a tube body having a flow nozzle with a burst disc therein.

In another example, FIG. 6B shows an arrangement where a tube body 250 has a burst insert 260 disposed thereon. The tube body 250 can be composed of any suitable materials, such as an erosion-resistant material, a stainless steel, a ceramic, or the like. The tube body 250 affixes at both ends to shunt tube sections 200*a-b* to form a portion of shunt tube interconnecting the flow passage 204. As depicted, the tube body 250 can weld to the ends of the tube sections 200*a-b*, although any other form of affixing the components together can be used.

As also shown here, a nozzle-style insert 260 (a.k.a. "nozzle") is integrally formed on the tube body 250, although it could be a separately welded component. The nozzle-style insert 260 in this example is a burst insert as before having a burst disc or barrier 264 disposed in the nozzle's passage 262, although the body 250 can use any of the other types of inserts disclosed herein, including an erosion insert (210: FIGS. 4A-4F), a burst insert (220: FIGS. 5A-5C), etc. As before, the barrier 264 is configured to burst from the buildup of slurry pressure at a predetermined point. This can be configured for a particular pressure buildup and can be designed for a particular implementation.

D. Dual Port Tube Element

Figure 7A:
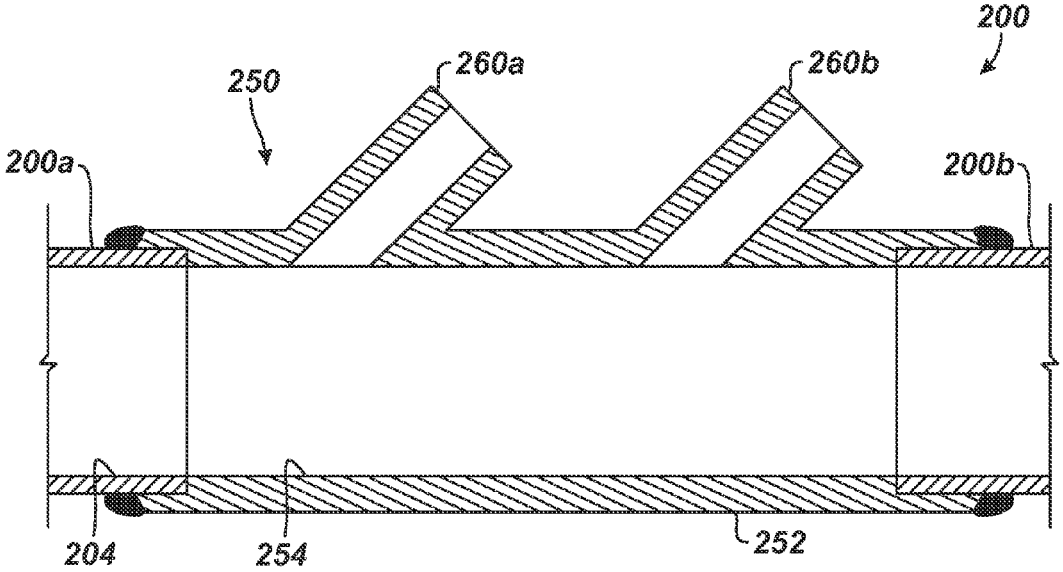
FIG. 7A is a side cross-sectional view of a tube body having multiple flow nozzles disposed thereon.

Previous embodiments have disclosed the use of independent and discrete flow inserts or nozzles disposed at exit ports along a shunt tube 200. In some implementations, it may be advantageous to use a cluster or collection of multiple inserts or nozzles at a given location on a shunt tube. For instance, FIG. 7A shown a shunt tube 200 having a tube body 250 that affixes to ends of shunt tube sections 200*a-b* to form a portion of shunt tube. As before, the tube body 250 can be composed of any suitable materials, such as an erosion-resistant material, a stainless steel, a ceramic, or the like.

Figure 7B:
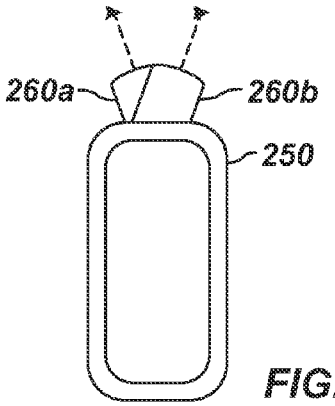
FIG. 7B-7C are end views of a tube body showing different orientations and configurations of the multiple flow nozzles.
Figure 7C:
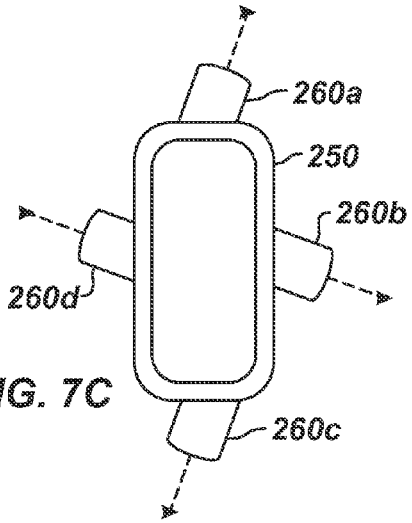

Rather than having a single flow nozzle as in previous embodiments, the tube body 250 has two or more nozzles or inserts 260*a-b* disposed together or in tandem on the tube body 250. Although two inserts 260*a-b* are shown in close connection to each other, any number of localized inserts 260*a-b* can be used. As shown in FIG. 7B, the multiple inserts 260*a-b* can be disposed on the same side of the tube body 250. Although the inserts 260*a-b* may have the same direction, the inserts 260*a-b* can have different angular orientations compared to one another, as shown in FIG. 7B. Moreover, as shown in FIG. 7C, several inserts 260*a-d* can be disposed on multiple sides or directions about the shunt tube body 250 depending on the space available and the desired flow direction for the exiting slurry.

Figure 7D:
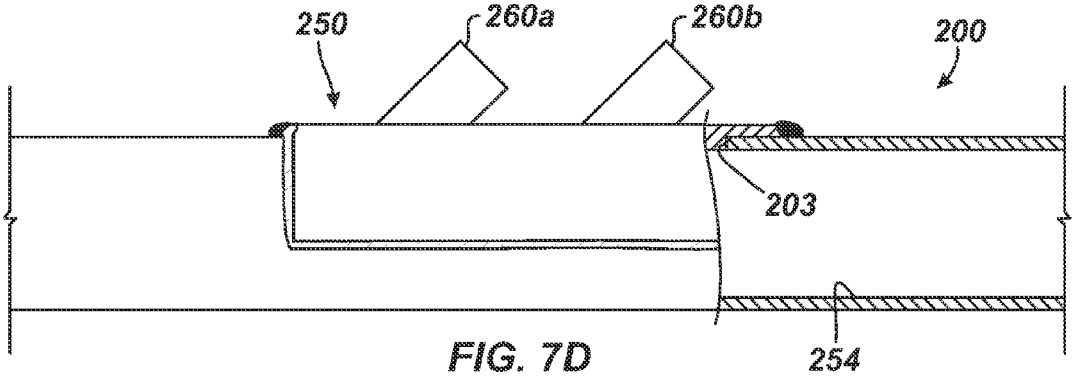
FIG. 7D is a side view in partial cross-section view of a partial tube body having multiple flow nozzles disposed thereon.

Finally, as shown in FIG. 7D, the tube body 250 need not completely form a segment of the shunt tube 250. Instead, sections of the shunt tube 200 may have an oversized opening or a missing side 203, and the tube body 250 can affix to the sections of the shunt tube 200 to cover the oversized opening or complete the missing side 203.

E. Erosion-Resistant Nozzle

Figure 1:
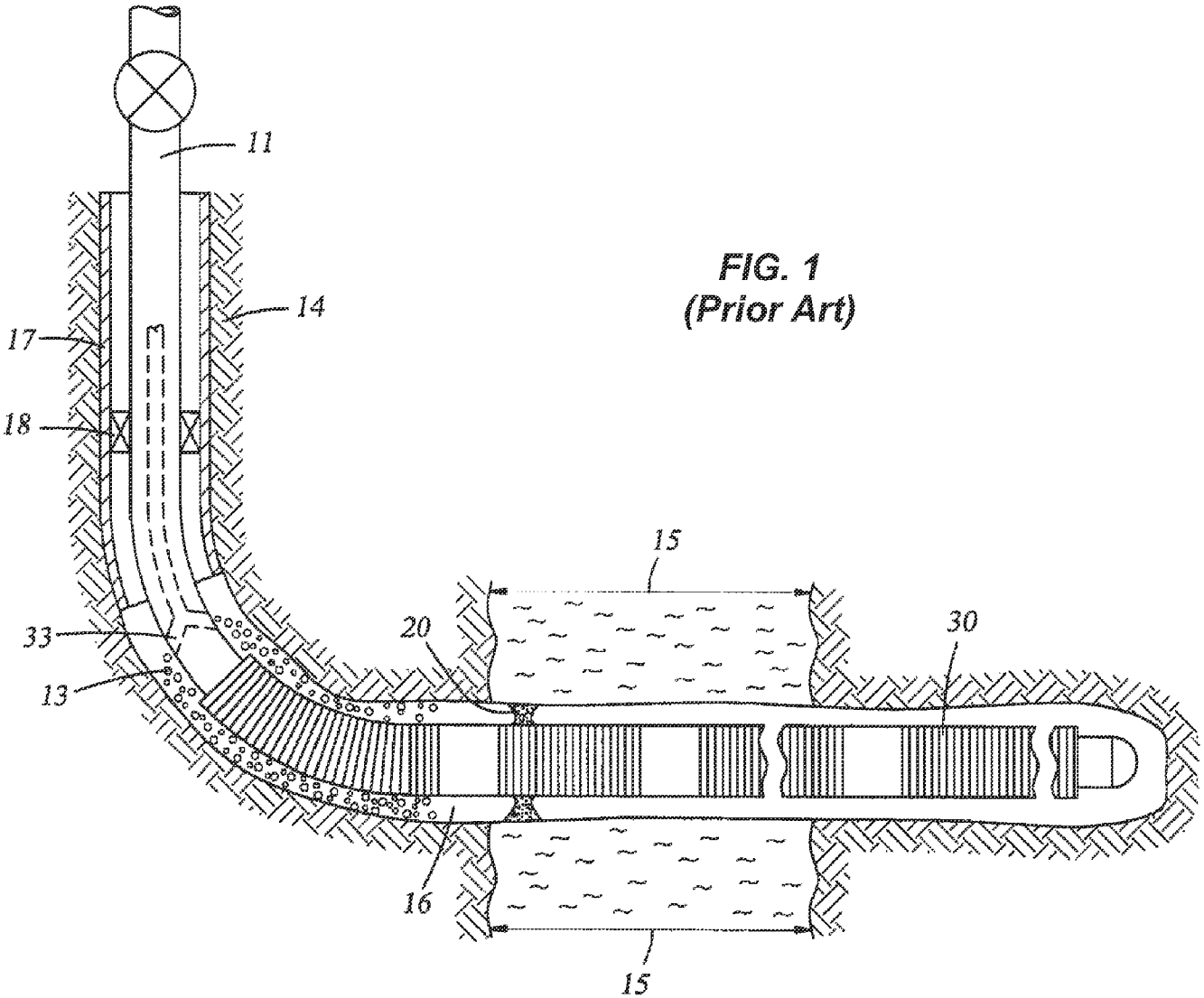
FIG. 1 (Prior Art)
FIG. 1 is a side view, partially in cross-section, of a horizontal wellbore with a wellscreen therein.
Figure 2B:
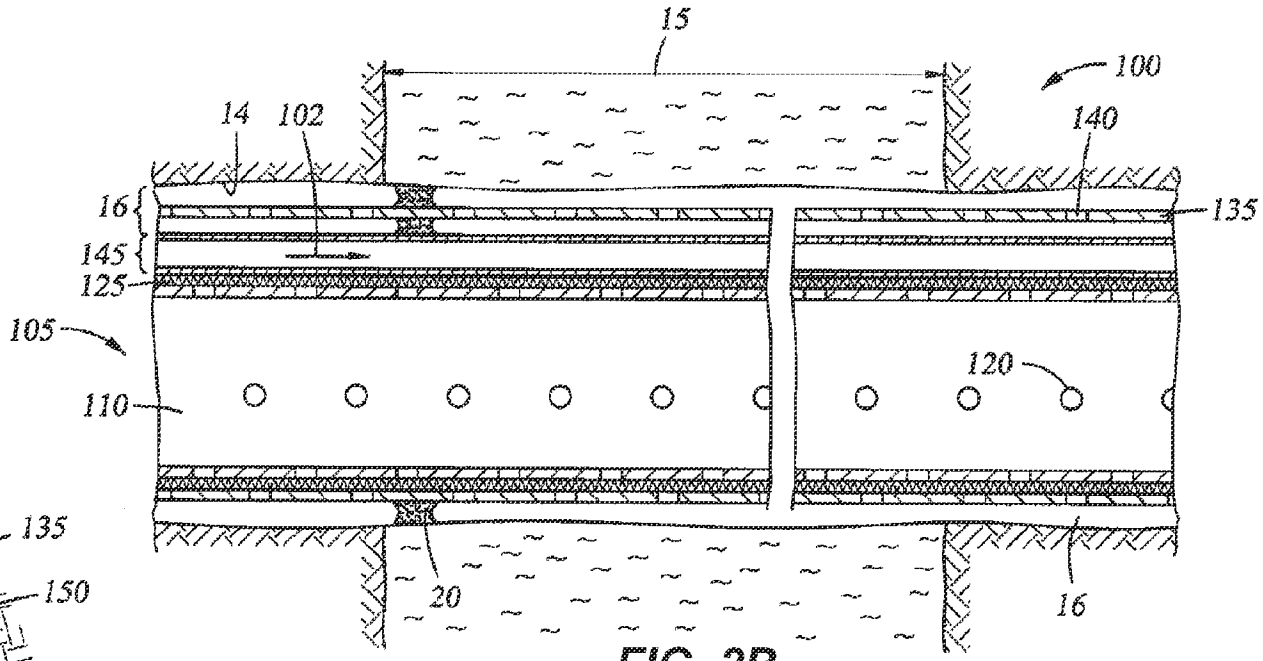
FIG. 2B (Prior Art)
FIG. 2B is a cross-sectional view of the gravel pack apparatus positioned within the wellbore adjacent a highly permeable area of a formation.
Figure 2C:
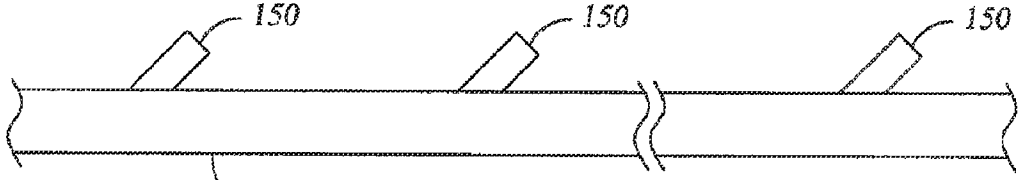
FIG. 2C (Prior Art)
FIG. 2C is a side view of a shunt tube showing placement of prior art nozzles along the shunt tube.
Figure 2A:
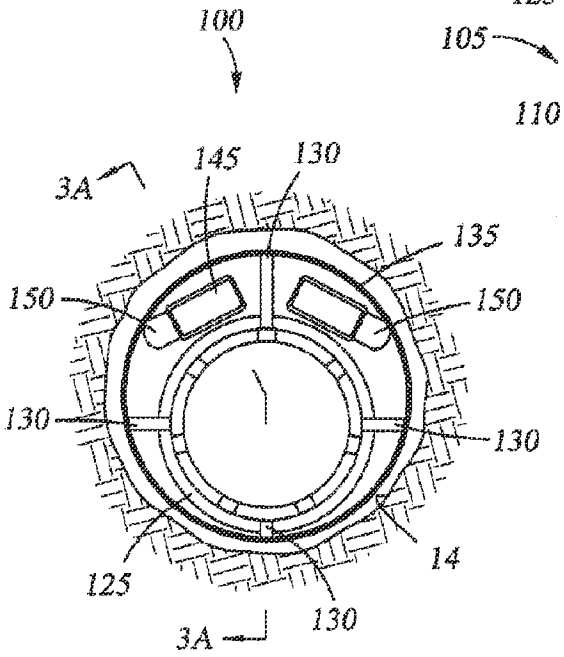
FIG. 2A (Prior Art)
FIG. 2A is an end view of a gravel pack apparatus positioned within a wellbore.
Figure 3B:
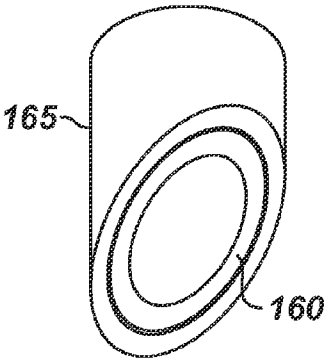
FIG. 3B (Prior Art)
FIG. 3B shows a perspective view of the prior art nozzle.
Figure 3C:
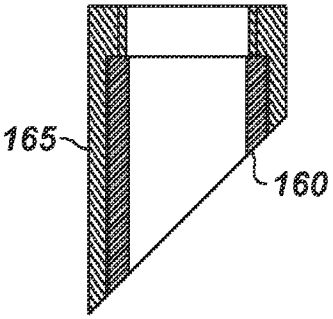
FIG. 3C (Prior Art)
FIG. 3C shows a cross-sectional view of the prior art nozzle.
Figure 3A:
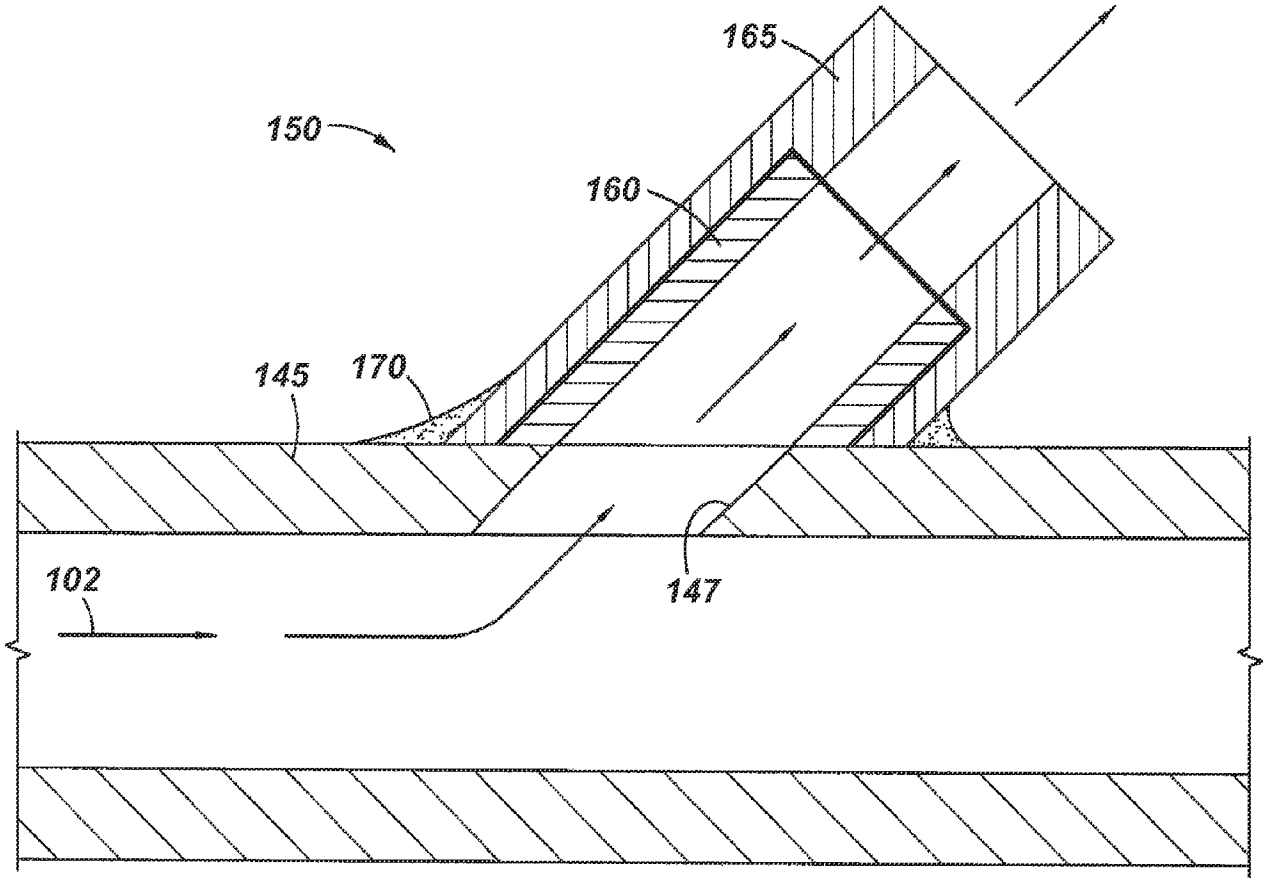
FIG. 3A (Prior Art)
FIG. 3A is a cross-sectional view of an erosion-resistant nozzle of the prior art disposed on a shunt tube.

As discussed previously, the typical configuration for preventing erosion at a flow nozzle of a shunt tube involves disposing an insert of erosion-resistant material inside a flow nozzle. See e.g., FIGS. 3A-3B.

1. Outsert

Figure 8A:
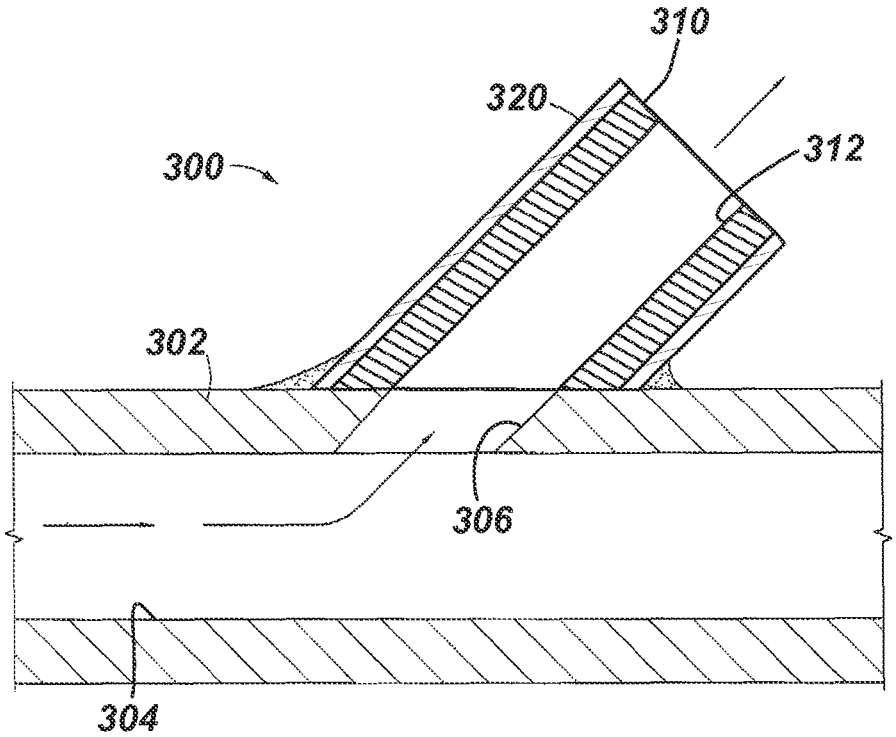
FIG. 8A is a side cross-sectional view of a flow nozzle disposed at the exit port of a shunt tube and having an external, erosion-resistant casing.

As an alternative, FIG. 8A shows an erosion-resistant design where a flow nozzle 310 affixes to the sidewall 302 of a shunt tube 300 at an exit port 306 as before. Rather than having an erosion-resistant insert disposed therein, the flow nozzle 310 has an external sheath or casing 320 disposed about the outer sidewall of the nozzle 310. The sheath 320 can be composed of erosion-resistant material, while the nozzle 310 can be composed of conventional material, such as 316L stainless steel. The outer sheath 320, even though not directly subject to erosive flow through the nozzle's passage 312, fortifies the nozzle 310. Additionally, should the material of the flow nozzle 310 erode during use, the outer sheath 320 of erosion-resistant material can act as the flow nozzle for the exit port 306. Any erosion-resistant material can be used, such as a tungsten carbide, a ceramic, or the like. The sheath 320 can be affixed to the flow nozzle 310 by press fitting, shrink fitting, brazing, welding, or the like, and may be affixed to the sidewall 302 of the shunt tube 300 separately or in conjunction with the flow nozzle 300.

2. Bushing-Cap I

Figure 8B:
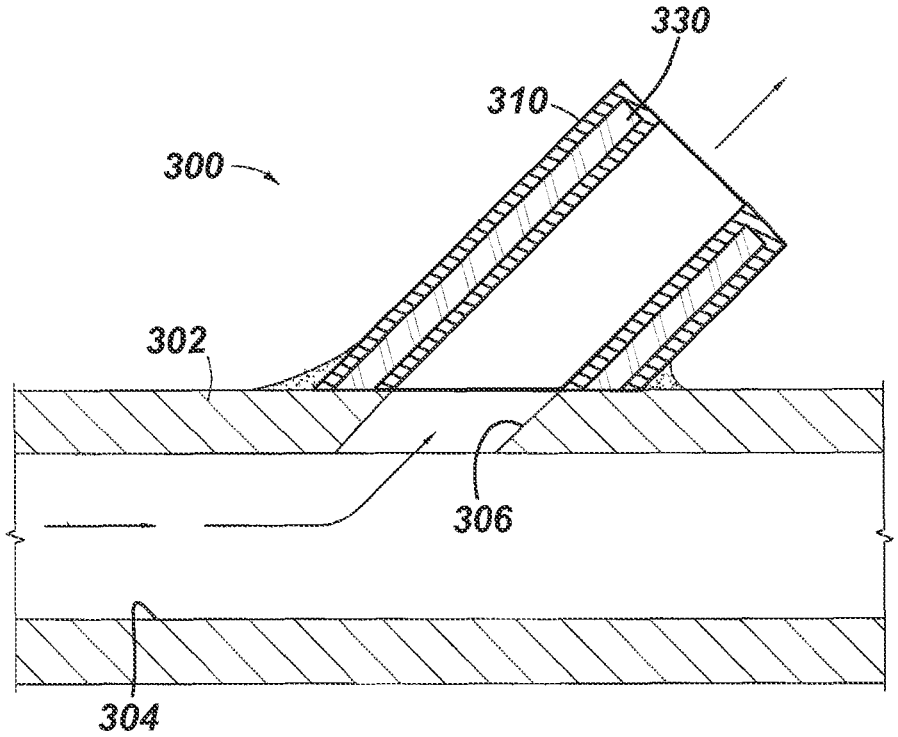
FIG. 8B is a side cross-sectional view of a flow nozzle disposed at the exit port of a shunt tube and having a cap enclosing internal and external surfaces of the flow nozzle.

A different configuration is shown in FIG. 8B. A bushing 330 composed of erosion-resistant material is disposed on the sidewall 302 of a shunt tube 300 at the exit port 306. Any erosion-resistant material can be used, such as a tungsten carbide, a ceramic, or the like. A flow nozzle 310 defines a pocket with sidewalls in the form of a cap or sheath. The flow nozzle 310 is composed of stainless steel or the like and affixes both inside and outside the bushing 330. The cap or sheath of the flow nozzle 310 can affix to the bushing 330 by press fitting, shrink fitting, brazing, welding, or the like. The flow nozzle 310 can be affixed to the sidewall 302 of the shunt tube 300 by welding or other known technique and can be affixed to the sidewall separately or in conjunction with the bushing 330.

3. Buildup

Figure 8C:
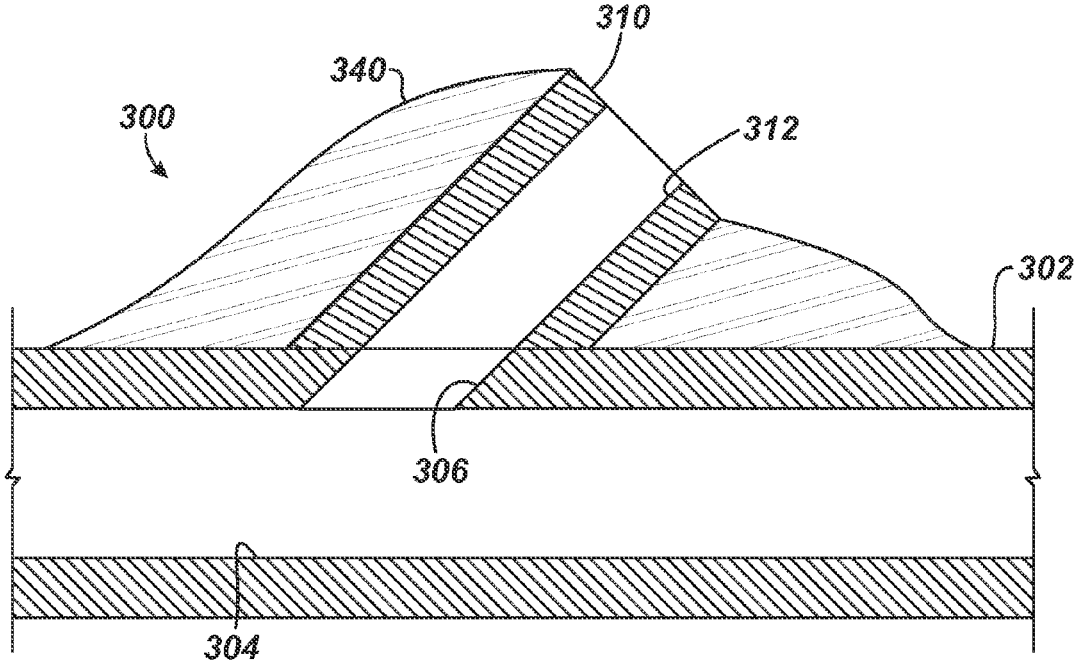
FIG. 8C is a side cross-sectional view of a flow nozzle disposed at the exit port of a shunt tube and having a harder, erosion-resistant material formed about the outside of the flow nozzle.

Yet another configuration shown in FIG. 8C has a flow nozzle 310 that is composed of stainless steel or the like and is affixed on shunt tube 300 at an exit port 306. Outside the nozzle 310, a hard, erosion-resistant material buildup 340 is disposed around the outside of the nozzle 310. The hard material buildup 320 can be composed of a more erosion-resistant material, while the nozzle 310 can be composed of conventional material, such as 316L stainless steel. The material used for the external buildup 340 can include a welding material, a hard banding, or a thermal spray metallic coating. The buildup 340 can use a coating or plating composed of any other suitable material, such as "hard chrome."

The external buildup 340, even though not directly subject to erosive flow, fortifies the nozzle 310. Additionally, should the material of the inner flow nozzle 310 erode during use, the external buildup 340 can operate as the flow nozzle 310 and even maintain the overall diameter of the exit port 306 to an extent. Finally, by having the nozzle 310 affixed in place first on the exit port 306, the nozzle 310 can help to contain the application of the hardened buildup 340 and to maintain a uniform opening on the shunt tube 302 for the exit port 306 once the buildup 340 is applied.

4. Bushing-Cap II

Figure 8D:
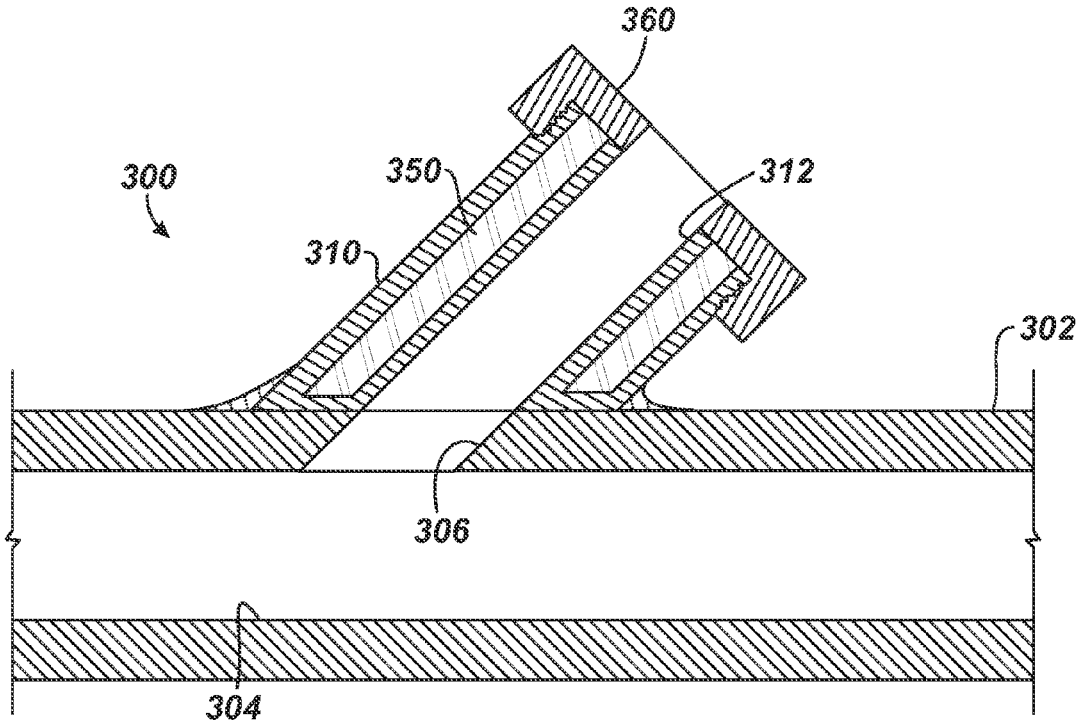
FIG. 8D is a side cross-sectional view of a flow nozzle disposed at the exit port of a shunt tube and having an erosion-resistant bushing held on the tip of the flow nozzle.

Finally, an erosion-resistant nozzle of FIG. 8D has a bushing 350 disposed in a flow nozzle 310 affixed to a shunt tube 300 at an exit port 306. The flow nozzle 310 can be composed of a typical material, such as stainless steel, which can be welded or readily attached to the shunt tube's sidewall 302 as before. The bushing 350 is composed of an erosion-resistant material, as discussed herein. As a reverse arrangement to FIG. 8B, the bushing 350 in FIG. 8D is disposed inside a pocket or slot in between sidewalls of the nozzle 310, which forms an inverted cap or sheath. As shown, the bushing 350 installs from the tip of the nozzle 310 to a distance short of the outside surface of the shunt tube 300. A threaded cap or other retainer 360 affixes to the end of the nozzle 310 to hold the bushing 350 in the nozzle 310.

Should erosion begin to wear the inside of the flow nozzle 310 (e.g., the surface of the inner sidewall exposed to the conducted slurry) and the inside of the cap 360, the erosion-resistant bushing 350 can act to reduce the erosive effects. Although not shown, a combination of the arrangements in FIGS. 8B and 8D can be used, where a bushing extends directly from the outside surface of the shunt tube 300 to the tip of the nozzle 310 to be held by a cap 360.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Thus, the insert or nozzle of one embodiment can be combined for use with an insert, nozzle, sheath, cap, bushing, etc. of another embodiment on a same shunt tube. Additionally, the tube bodies 250 of FIGS. 6B through 7D can use any one of or any combination of the various insert, nozzle, sheath, cap, bushing, etc. disclosed herein. Finally, additional details of erosion resistant flow nozzle for downhole tools can be found in U.S. application Ser. No. 13/292,965, filed 9 Nov. 2011, which is incorporated herein by reference in its entirety.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack apparatus for a wellbore, comprising:

a flow tube having a flow passage conducting slurry in a conducted direction from a proximal end toward a distal end of the flow tube, the flow tube having a plurality of flow ports disposed along a length of the flow tube for passing the conducted slurry into the wellbore; and a plurality of inserts disposed in the flow ports, each of the inserts defining at least one aperture therethrough and being composed of an erodible material, each of the inserts eroding via the conducted slurry passing through the at least one aperture and allowing passage of the conducted slurry from an initial flow rate to a subsequently greater flow rate, wherein the inserts are designed differently from one another in order to erode at different rates from one another in a predetermined pattern along the length of the flow tube, the predetermined pattern comprising at least one of the inserts disposed towards one of the proximal and distal ends eroding at at least one of the different rates before at least another of the inserts disposed towards the other of the proximal and distal ends eroding at at least another of the different rates.

2. The apparatus of claim 1, wherein each of the inserts comprises at least one slot defined at least partially in at least one side thereof.

3. The apparatus of claim 1, wherein the inserts are configured to erode at the different rates from one another with respect to the at least one aperture in the predetermined pattern along the length of the flow tube based on a number and/or a size of the at least one aperture in the inserts.

4. The apparatus of claim 1, wherein each of a plurality of the at least one insert disposed toward the proximal end of the flow tube is configured to erode at the different rates from one another in the predetermined pattern along the conducted direction before each of a plurality of the at least one other insert disposed toward the distal end of the flow tube.

5. The apparatus of claim 1, wherein the inserts comprise a same or different number of the at least one aperture defined therein.

6. The apparatus of claim 1, wherein at least one of the inserts comprises a thread disposed thereabout and threading into the at least one flow port of the flow tube.

7. The apparatus of claim 1, further comprising:

a basepipe having a through-bore and defining a perforation communicating into the through-bore; and a screen disposed on the basepipe adjacent the perforation, wherein the flow tube is disposed adjacent the screen.

8. The apparatus of claim 1, wherein the inserts disposed in the flow ports at least temporarily obstruct flow of the conducted slurry through the flow ports.

9. The apparatus of claim 1, wherein the inserts are configured to erode in the predetermined pattern relative to one another along the length of the flow tube.

10. The apparatus of claim 1, further comprising at least one blank disposed in at least one of the flow ports and preventing flow of the conducted slurry through that at least one flow port.

11. The apparatus of claim 2, wherein the inserts are configured to erode at the different rates from one another with respect to the at least one slot in the predetermined pattern along the length of the flow tube based on a number and/or a size of the at least one slot in the inserts.

12. The apparatus of claim 2, wherein each of the inserts erodes at the at least one aperture and along the at least one slot via the conducted slurry passing through the at least one aperture.

13. The apparatus of claim 1, wherein the inserts are configured to erode at the different rates from one another in the predetermined pattern along the length of the flow tube based on thicknesses, diameters, and/or materials configuring erosion characteristics of the inserts.

14. The apparatus of claim 6, wherein the insert comprising the thread threading into the at least one flow port of the flow tube is configured to come out of the flow port.

15. The apparatus of claim 1, wherein the flow tube is composed of a stainless steel.

16. The apparatus of claim 1, wherein the inserts are composed of an eroding material, a soft metal, a brass, or an aluminum.

17. The apparatus of claim 1, wherein that at least one aperture is sized relative to a mean diameter of gravel in the slurry.

18. The apparatus of claim 1, wherein the predetermined pattern comprises a plurality of the inserts mixed between the proximal and distal ends eroding at the different rates before and after one another.

19. The apparatus of claim 1, wherein the predetermined pattern comprises each of a plurality of the at least one insert disposed toward the distal end eroding at the different rates before each of a plurality of the at least other insert disposed toward the proximal end.

* * * * *